US005806714A

United States Patent [19]

Geiger

[11] Patent Number: 5,806,714

[45] Date of Patent: Sep. 15, 1998

[54] LABEL DISPENSER

[75] Inventor: Gerard G. Geiger, Jackson, Wis.

[73] Assignee: Tyton-Hellermann Corporation, Milwaukee, Wis.

[21] Appl. No.: 678,090

[22] Filed: Jul. 11, 1996

[51] Int. Cl.[6] ..... G07F 11/00

[52] U.S. Cl. ..... 221/73; 221/70; 221/22

[58] Field of Search ..... 221/73, 22, 70, 221/72

[56] References Cited

U.S. PATENT DOCUMENTS

| | | | |
|---|---|---|---|
| 2,341,368 | 1/1944 | Flood | 221/73 |
| 2,912,140 | 11/1959 | Cole | 221/70 |
| 3,107,814 | 10/1963 | Auger et al. | 221/73 |
| 3,283,886 | 11/1966 | Addis et al. | 221/70 |
| 3,388,830 | 6/1968 | Short | 221/73 |
| 3,740,299 | 6/1973 | Schroter et al. . | |
| 3,793,123 | 2/1974 | Aronson . | |
| 3,861,560 | 1/1975 | Entwistle et al. | 221/70 |
| 3,913,786 | 10/1975 | Kartasuk | 221/70 |
| 4,162,739 | 7/1979 | Nelson | 221/70 |
| 4,496,049 | 1/1985 | Pabodie et al. | 221/70 |
| 4,574,979 | 3/1986 | Hackett | 221/73 |
| 4,700,835 | 10/1987 | Rognsvoog, Jr. | 221/70 |

FOREIGN PATENT DOCUMENTS

| | | |
|---|---|---|
| 0 218 255 | 4/1987 | European Pat. Off. . |
| 0 373 217 | 6/1990 | European Pat. Off. . |
| 1349490 | 4/1964 | France . |
| 232 472 | 11/1986 | German Dem. Rep. . |
| 29511439 | 9/1995 | Germany . |
| 1156663 | 7/1969 | United Kingdom . |

*Primary Examiner*—William E. Terrell
*Assistant Examiner*—Khoi H. Tran
*Attorney, Agent, or Firm*—Ryan, Maki, Mann & Hohenfeldt

[57] ABSTRACT

A label dispenser for dispensing labels stored on a backing tape includes a main housing and a top cover that are connected at one end by a first hinge and an access door connected to the main housing by a second hinge. The top cover, main housing and access door form an enclosure having a storage compartment, a dispensing slot, a tape discharge slot and a writing window. A roll of labels stored on a backing tape is contained within the compartment and is threaded through the window and the tape discharge slot so that the labels are dispensed through the dispensing slot when the backing tape is pulled through the tape discharge slot. Information can be written on the labels as they pass through the writing window. Preferably, the top cover, the main housing and the access door are all formed as a single, unitary structure in a single injection molding operation.

18 Claims, 3 Drawing Sheets

66
76
34
38
50
42
52
68
36
30
32
48
44
46
12
24
22
28
40

LABEL DISPENSER

FIELD OF THE INVENTION

This invention relates generally to label dispensers, and more particularly, to label dispensers that dispense labels stored on a backing tape.

BACKGROUND OF THE INVENTION

Identification labels are used in a variety of construction and building projects. Such labels are typically used during wiring to help identify and distinguish individual wires, cables or conduits from others that are in the same area and look just the same. Proper labeling is of tremendous help in completing, inspecting and servicing a wiring installation. Proper labeling is also of help in other types of installations, such as plumbing, wherein it is helpful to identify and distinguish among several, often identically appearing structures. Additionally, such labels can be used on packaging, in performing inspections and for applying UPC labels on products.

To assist those engaged in installing wiring, plumbing and the like, preformed, blank, adhesive labels have been developed. Such labels are typically distributed and stored on a rolled, elongate backing tape prior to use. As the labels are needed, they are pulled off the backing tape and wrapped around the wire or cable. Each label includes a blank surface on which identifying information can be written before the label is wrapped around the wire or cable.

Various forms of dispensers have been developed for storing and dispensing such labels. Typically, such dispensers have included a housing for storing the roll of unused labels, a backing or writing surface that supports the label while identifying information is written onto the label, and a dispensing end for dispensing the completed label. Although generally effective, prior label dispensers were sometimes awkwardly shaped, uncomfortable to hold and difficult to use. These drawbacks were real and significant to actual users who typically do not work at a desk and write on the labels with one hand while standing and holding the dispenser with the other. Additionally, given that labels and label dispensers are generally low cost, high volume items that compete largely on the basis of value and economy, prior label dispensers were frequently a compromise between effective functional design and manufacturing economy. Such prior label dispensers suffered from such problems as jamming within the dispenser, difficulty in removing labels from the dispenser and difficulty in writing on a label prior to its being dispensed.

SUMMARY OF THE INVENTION

The invention provides a label dispenser for containing a roll of labels stored on a backing tape and dispensing the labels one at a time. The label dispenser includes a main housing joined to a top cover by means of a first integrally formed live hinge. The label dispense further includes an access door joined to the main housing by means of a second integrally formed live hinge.

The invention also provides a label dispenser including an enclosure having a top cover and a main housing. The top cover and main housing are connected at one end by a hinge and are movable around the hinge to bring the top cover and main housing together to define a compartment therebetween. The top cover includes an upper surface having an elongate aperture or window formed therein. The main housing includes a label dispensing slot and a tape discharge slot spaced from the dispensing slot. A roll of labels on a tape is housed in the compartment and is threaded so that the labels exit the enclosure through the label dispensing slot and so that the tape exits the enclosure through the tape discharge slot.

In one embodiment, the top cover, the main housing, the access door and the first and second live hinges are formed as a unitary structure.

In one embodiment, the top cover, the main housing, the access door and the first and second live hinges are formed by means of injection molding.

In one embodiment, the top cover is pivotable into closing relationship with the main housing to form an enclosure having a compartment for storing the roll of labels at one end, a dispensing slot for dispensing labels at the other end and a window intermediate the compartment and the dispensing slot for supporting the labels from underneath while providing access to the labels from above as the labels pass between the compartment and the dispensing slot.

In one embodiment, the top cover includes an aperture and the main housing includes a ramp that lies under the aperture when the top cover and main housing are pivoted into closing relationship relative to each other. The window is formed by the cooperating relationship of the aperture of the top cover with the ramp of the main housing.

In one embodiment, the access door is pivotable around the second live hinge into closing relationship with the main housing.

In one embodiment, the access door includes an end spaced from the main housing member to define a tape discharge slot when the access door is pivoted into closing relationship with the main housing.

It is an object of the invention to provide a new and improved label dispenser.

It is a further object of the invention to provide a label dispenser offering improved performance.

It is a further object of the invention to provide a label dispenser that is easy to hold and operate and that fits comfortably into a pocket.

It is a further object of the invention to provide a label dispenser that is easy to load.

It is a further object of the invention to provide a label dispenser wherein the user can write on a blank label before it is dispensed.

It is a further object of the invention to provide a label dispenser that is water resistant and protects unused labels from exposure to water or dust.

It is a further object of the invention to provide a label dispenser that is reusable.

It is a further object of the invention to provide a label dispenser that is hangable from a hook on a belt or display.

BRIEF DESCRIPTION OF THE DRAWINGS

The features of the invention that are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PREFERRED EMBODIMENT

Figure 1:
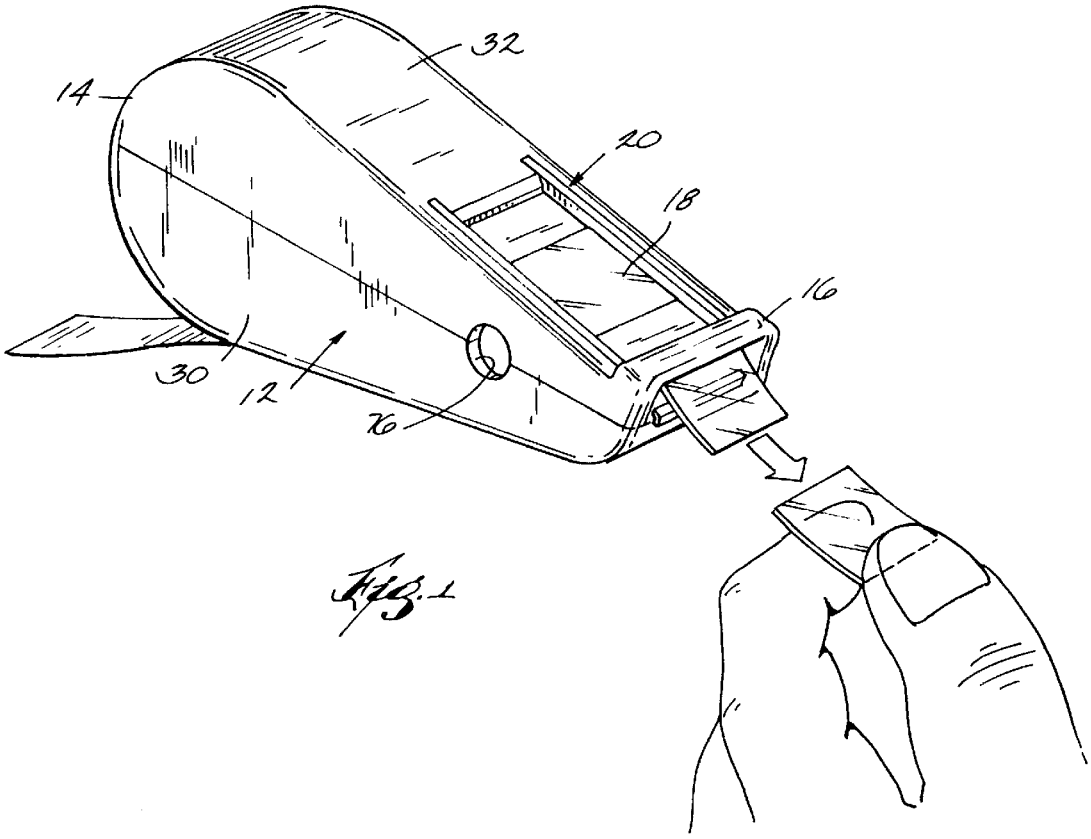
FIG. 1 is an isometric view of a label dispenser embodying various features of the invention.
Figure 2:
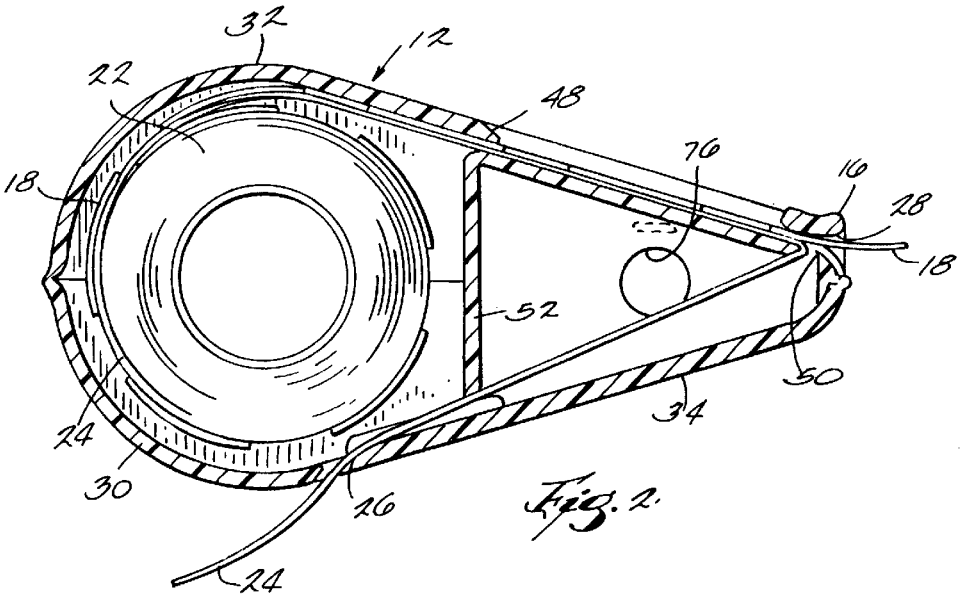
FIG. 2 is a side sectional view of the label dispenser showing the dispenser in a closed position.

Referring to the drawings, and, in particular, to FIGS. 1 and 2, a label dispenser 10 embodying various features of the invention is shown in a "ready-to-use" condition. The label dispenser 10 includes a generally tear-drop shaped enclosure 12 having an enlarged or storage end 14 and a tapered or dispensing end 16. The tear-drop shaped enclosure 12 is shaped so as to be easily hand-held by the user. Unused or fresh labels 18 are contained in the enlarged storage end 14 of the enclosure 12 and are dispensed at the tapered dispensing end 16. As each fresh label 18 passes from the storage end 14 to the dispensing end 16, it passes through an exposed area or "writing window" 20. Within the writing window 20, the label 18 is supported underneath by the dispenser and is accessible from above so that the user can write identifying information onto the label 18 before it is dispensed.

In accordance with conventional practice, fresh labels 18 are initially obtained from the manufacturer in the form of a roll 22. The labels 18 themselves are mounted on an elongate, flexible backing tape 24 that holds the labels 18 until they are dispensed. In the illustrated embodiment, the roll 22 of fresh labels 18 is contained in the enlarged end 14 of the enclosure 12. The backing tape 24 holding the labels 18 is threaded through the window 20 toward the tapered dispensing end 16. The backing tape 24 itself, however, is looped back toward to the storage end 14 and exits the enclosure 12 through a tape discharge slot 26 in the bottom of the enclosure 12 near the storage end 14. The labels 18 on the backing tape 24, however, dispense forwardly through a dispensing slot 28 formed at the dispensing end 16 of the enclosure 12. In use, the user pulls the backing tape 24 through the tape discharge slot 26 sufficiently to advance a fresh label 18 to the window 20. After writing the desired identifying information on the fresh label 18, the user again pulls the backing tape 24 to advance the label 18. As the tape 24 bends around the dispensing end 16 of the enclosure 12, the labels 18 automatically peel away from the tape 24 and are discharged forwardly through the dispensing slot 28.

Figures 3, 4, 5:
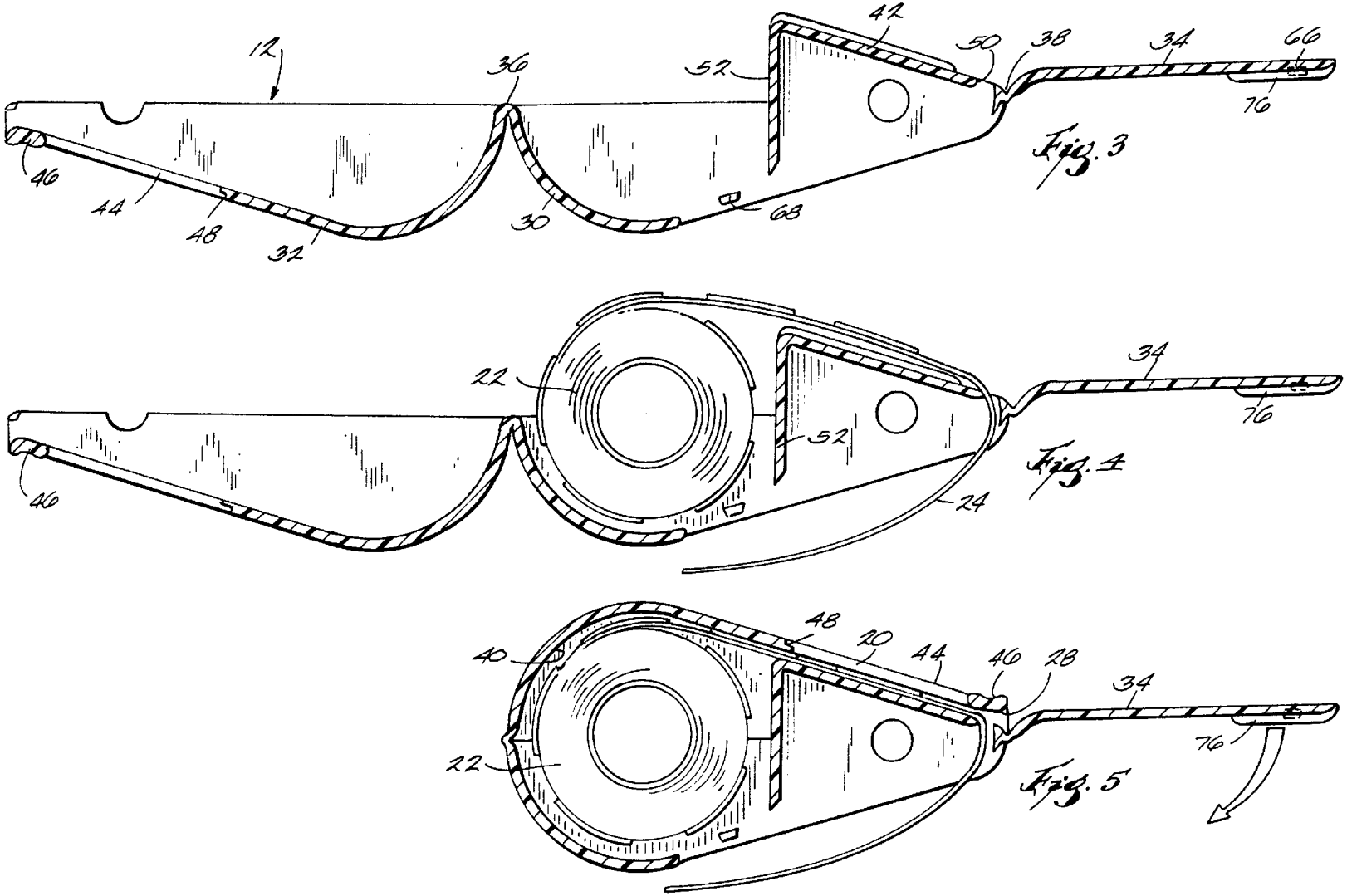
FIG. 3 is a side sectional view of the label dispenser showing the dispenser in an open position.
FIG. 4 is a side sectional view showing the label dispenser in an open position and further showing a roll of labels being threaded into the dispenser.
FIG. 5 is a side sectional view similar to FIG. 4 showing the label dispenser in a partially closed position while threading the roll of labels.

Referring further to FIGS. 3–5; the enclosure 12 comprises a single, unitary structure having a main housing 30, a top cover 32 and an access door 34. The enclosure 12 is preferably injection molded as a single, unitary piece using a suitable plastic, such as polypropylene, with a pair of integrally formed "live" hinges 36, 38 joining the top cover 32 and the access door 34, respectively, to the main housing 30. The design of the label dispenser 10 lends itself to forming the enclosure 12 in a single injection molding step using a single mold. Forming the enclosure 12 as a unitary member, and in a single step, greatly reduces manufacturing, handling, inventory and assembly costs.

As illustrated, both the top cover 32 and main housing 30 are hollow and cooperate to define a compartment 40 for housing the roll 22 of fresh labels 18. The hinge 36 between top cover 32 and main housing 30 permits the top cover 32 and main housing 30 to be pivoted away from each other to expose and gain access to the compartment 40. New rolls 22 of fresh labels can thus be inserted into the enclosure 12 by pivoting the top cover 32 and main housing 30 away from each other. The access door 34 swings downwardly away from the underside of the main housing 30 on the hinge 38 and provides access to the underside of the main housing 30. Such access is useful in loading a fresh roll 22 of labels 18 and simplifies the task of molding the main housing 30 as a single unit.

The writing window 20 is defined through the cooperating relationship of the top cover 32 and main housing 30 when they are closed as shown in FIGS. 1 and 2. The main housing 30 includes an upper ramp 42 that defines a writing surface for supporting or "backing up" a label 18 within the window 21 as it is being written upon. The overlying portion of the top cover 32 includes an elongate aperture 44 through which the writing surface, and a label 18 thereon, is exposed. The forward end of the aperture 44 is defined by a raised crossbar 46 under which the labels 18 pass as they are discharged from the dispenser 10. The rear end of the aperture is defined by a tension tab 48 that overlies and bears against the rear end of the upper ramp 42 when the top cover 32 and main housing 30 are closed. The backing tape 24 and the labels 18 thereon pass between the tab 48 and the upper ramp 42. This helps hold the backing tape 24 and the labels 18 firmly down and flat against the writing surface. This also helps keep tension on the backing tape 24 as it is pulled through the enclosure 12.

The dispensing slot 28 through which the labels 18 pass as they are dispensed is defined between the raised crossbar 46 and the forward end of the main housing 30. The forward end of the main housing 30 is rounded and is vertically spaced from the raised crossbar 46 to form the dispensing slot 28. The forward end is also spaced horizontally from the forward end of,the ramp 42 to form an additional or reversing slot 50 through which the backing tape 24, but not the labels 18 stuck thereon, is threaded. Preferably, the tab 48 overlaps the forward end of the ramp 42 as shown in FIG. 2 to help hold the backing tape 24 and labels 18 firmly down and flat against the writing surface. The forward end of the ramp 42 forms a delaminating edge that is preferably pointed as illustrated. The delaminating edge ensures that the backing tape 24 makes a sharp bend as it passes through the reversing slot 50. The tension of the tab 48 keeps the backing tape 24 tight against the delaminating edge. The resulting sharp bend of the backing tape 24 causes the labels 18 to peel away from the backing tape 24 and continue forwardly through the dispensing slot 28.

As further illustrated in FIG. 2, the backing tape 24, after first being threaded through the reversing slot 50, exits the enclosure 12 through the tape discharge slot 26. The tape discharge slot 26, in turn, is defined between the non-hinged end of the access door 34 and the adjacent portion of the main housing 30 when the access door 34 is closed. Preferably, the adjacent portion of the main housing 30 is chamfered to avoid peeling the labels 18 off the backing tape 24 as the tape 24 and labels 18 are drawn from the roll 22. Preferably, the upper ramp 42 includes a downwardly extending leg 52 that terminates just above the access door 34. The backing tape 24 is thus confined between the access door 34 and the end of the leg 52 to help keep the backing tape 24 properly threaded along the access door 34 and through the tape discharge slot 26.

Figure 7:
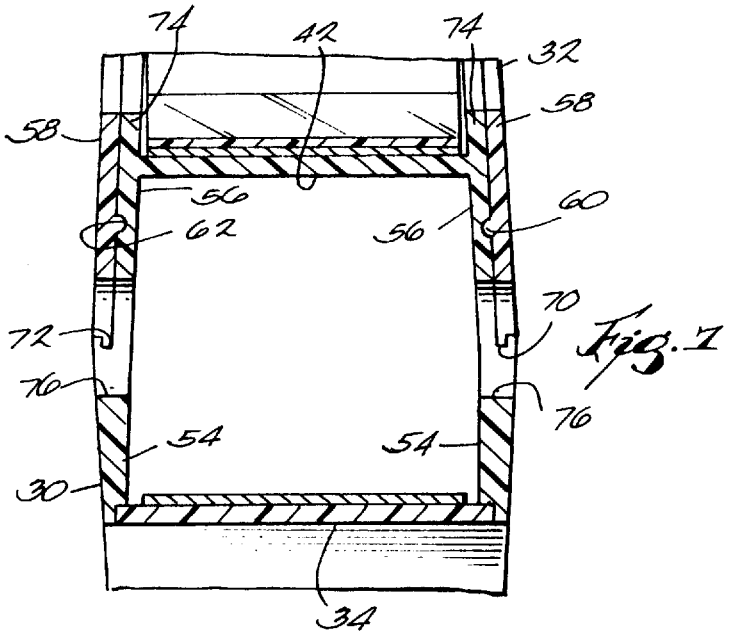
FIG. 7 is a sectional view taken along line 7—7 in FIG. 6.
Figure 6:
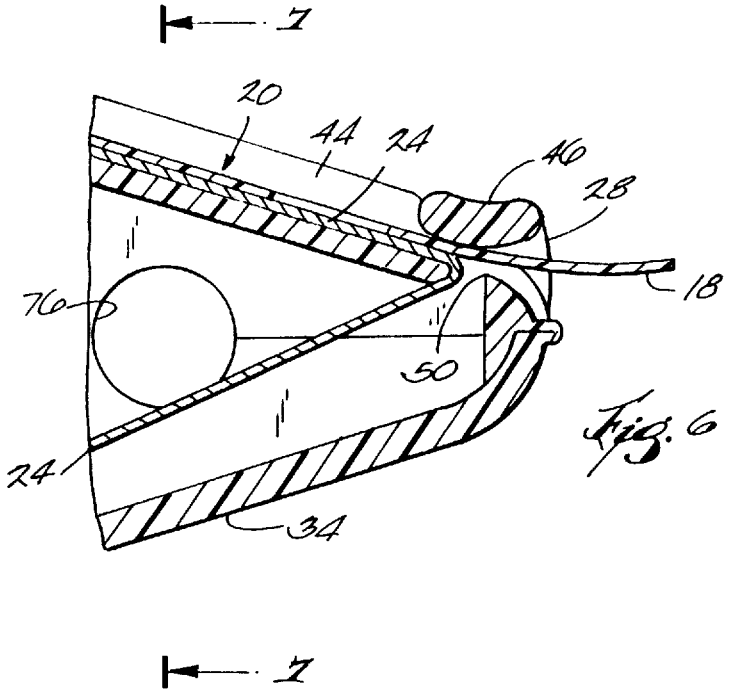
FIG. 6 is a partial side sectional view of one end of the label dispenser.

Referring now to the cross-sectional view of FIG. 7, it will be understood that the upper ramp 42 of the main housing 30 projects upwardly from the sidewalls 54 of the main housing 30 as shown. In addition, the sidewalls 56 of the upper ramp 42 are inwardly recessed from the sidewalls 54 of the lower housing 30. This enables the sidewalls 58 of the top cover 32 to pass alongside the sidewalls 56 of the ramp 42 when the top cover 32 and main housing 30 are closed as illustrated. The sidewalls 58, 54 of the top cover 32 and main housing 30 thus cooperate to provide the label dispenser 10 with a smooth exterior. Preferably, the outer walls of the housing taper outwardly toward the center as shown with a nominal 30 draft angle. In addition, the spacing between the top cover and ramp sidewalls 58, 56 is sufficiently close so that friction therebetween helps keep the top cover 32 and main housing 30 together when the enclosure 12 is closed. Additionally, slots 60 and tabs 62 can be provided to help lock the top cover 32 and main housing 30 together. Similarly, the access door 34 is also received into a notched recess 64 formed in the lower surface of the main housing 30 and is retained by means of a similar tab 66 and slot 68 (FIG. 3) arrangement.

A tongue 70 formed along the lower edge of the top cover 32 mates with a groove 72 formed along the top edge of the main housing 30 to help improve the seal between the top cover 32 and main housing 30 and to help keep the edges from moving laterally away from each other when the top cover 32 and main housing 30 are closed. The close fitting relationship of the various housing members provides a degree of water and dust resistance that help keep the labels 18 dry and clean even when the dispenser 10 is used in a wet or dusty environment. Finally, the upper end of the upper ramp 42 includes two raised guides or rails 74 that help confine the backing tape 24 and fresh labels 18 within the window 20. Similar rails 76 are formed on the access door. The rails 74 and 76 prevent the tape from migrating into the gaps between the various housing members when the housing is closed. This helps keep the design friction resistance of the housing constant as the tape is pulled.

To load the label dispenser 10 with a spool or roll 22 of fresh labels 18, the top cover 32 and main housing 30 are separated and the access door 34 is opened as shown in FIG. 3. The roll 22 is then placed in the compartment 40 with the leading edge of the backing tape 24 and labels 18 extending toward the ramp 42. The backing tape 24 and labels 18 are threaded over the top surface of the ramp 42 between the guides 70 toward the forward end of the main housing 30. The backing tape 24 is threaded through the reversing slot 50 and pulled toward the rear of the main housing 30 as shown in FIG. 4. The top cover 32 is then lowered and snapped into position as shown in FIG. 5. The access door 34 is closed and snapped into place, while the end of the backing tape 24 pulled beyond the end of the lower opening in the main housing 30. This leaves the end of the backing tape 24 extending through the backing tape discharge slot 26. When the backing tape 24 is thereafter pulled through the backing tape discharge slot 26, the backing tape 24 and the labels 18 it carries are pulled from the roll 22 and pass, one at a time, through the writing window 20. As the backing tape 24 is further pulled, the inherent stiffness of the labels 18 causes them to separate from the backing tape 24 and pass through the discharge slot 26 as the backing tape 24 abruptly changes direction while passing through the reversing slot 50.

Preferably, a pair of coaxially aligned holes 76 are formed through the sides of the label dispenser 10 near the dispensing end 16. These holes 72 permit the label dispenser 10 to be hung on a suitable hanger at a point of purchase display before the dispenser 10 is sold and then from the user's belt after it is sold.

The label dispenser shown and described herein offers many advantages over prior designs. The one-piece enclosure configuration allows the dispenser to be formed in a single injection molding step. This greatly reduces the cost and complexity associated with manufacturing, organizing, storing, tracking and assembling multiple parts. The shape of the dispenser conforms to the users' hand, and fits easily within the users' pocket, to increase user comfort and convenience. The writing window is conveniently placed to simplify the task of writing labels. Finally, the water resistant, close-fitting relationship of the enclosure components protects the fresh labels from the elements when the label dispenser is used outdoors.

While a particular embodiment of the invention has been shown and described, it will be obvious to those skilled in the art that changes and modifications can be made without departing from the invention in its broader aspects, and, therefore, the aim in the appended claims is to cover all such changes and modifications as fall within the true spirit and scope of the invention.

I claim:

1. A label dispenser for containing a roll of labels stored on a backing tape and dispensing the labels one at a time, comprising a main housing joined to a top cover by means of a first integrally formed live hinge and an access door joined to the main housing by means of a second integrally formed live hinge, wherein the housing has a storage end and a dispensing end and wherein the top cover and the main housing are shaped so as to form, when closed together, a substantially tapered enclosure having a rounded end of relatively larger dimension at the storage end and a rounded end of relatively smaller dimension at the dispensing end.

2. A label dispenser as defined in claim 1 wherein the top cover, the main housing, the access door and the first and second live hinges are formed as a unitary structure.

3. A label dispenser as defined in claim 2 wherein the top cover, the main housing, the access door and the first and second live hinges are formed by means of injection molding.

4. A label dispenser as defined in claim 1 wherein the enclosure is dimensioned to fit within a hand.

5. A label dispenser as defined in claim 1 wherein the housing has a storage end and a dispensing end and wherein the top cover is pivotable into closing relationship with the main housing to form an enclosure having a compartment for storing the roll of labels at the storage end, a dispensing slot for dispensing labels at the dispensing end and a writing window intermediate the compartment and the dispensing slot for supporting the labels from underneath while providing access to the labels from above as the labels pass between the compartment and the dispensing slot.

6. A label dispenser for containing a roll of labels stored on a backing tape and dispensing the labels one at a time, comprising a main housing joined to a top cover by means of a first integrally formed live hinge and an access door joined to the main housing by means of a second integrally formed live hinge wherein the housing has a storage end and a dispensing end, wherein the top cover and the main housing are shaped so as to form, when closed together, a substantially tapered enclosure having a rounded end of relatively larger dimension at the storage end and a rounded end of relatively smaller dimension at the dispensing end, wherein the top cover includes an aperture and wherein the main housing includes a ramp that lies under the aperture when the top cover and main housing are pivoted into closing relationship so that the window is formed by the cooperating relationship of the aperture of the top cover with the ramp of the main housing.

7. A label dispenser as defined in claim 6 wherein the access door is pivotable around the second live hinge into closing relationship with the main housing.

8. A label dispenser as defined in claim 7 wherein the access door includes an end opposite said second live hinge that defines a tape discharge slot when the access door is pivoted into closing relationship with the main housing.

9. A label dispenser comprising:

a teardrop shape enclosure having a main housing and a top cover, the top cover and main housing being connected at one end by a hinge and movable around the hinge to bring the top cover and main housing together to define a compartment therebetween;

the top cover including an upper surface having an elongate aperture formed therein;

the main housing having a dispensing slot formed therein and a tape discharge slot spaced from the dispensing slot; and a single roll of labels on a tape housed in the compartment and threaded so that the labels exit the enclosure through the dispensing slot and the tape exits the enclosure through the tape discharge slot.

10. A label dispenser as defined in claim 9 further including a ramp in the main housing located below the elongate aperture in the top cover when the top cover and main housing are moved into engagement with each other, and over which the labels on the tape are threaded in passing from the roll to the dispensing slot so that the labels are accessible through the elongate aperture while passing to the dispensing slot.

11. A label dispenser comprising:

a teardrop shaped enclosure having a storage end, a dispensing end, a compartment at the storage end, a dispensing slot at the dispensing end and a tape discharge slot between the compartment and the dispensing slot;

a roll of labels stored on a backing tape housed in the compartment;

a planar member within the enclosure between the compartment and the dispensing slot supporting the backing tape and the labels stored thereon; and an elongated aperture in the enclosure overlying the planar member and providing access to the labels supported by the planar member;

the enclosure including an access door having an open position and a closed position wherein, in the closed position, an end of the access door, in cooperation with the enclosure, defines the tape discharge slot; and wherein the roll is positioned in the enclosure such that the backing tape exits the enclosure through the tape discharged slot and the labels are discharged through the dispensing slot when the backing tape is pulled through the tape discharge slot.

12. A label dispenser as defined in claim 11 wherein the access door is pivotally connected to the enclosure by a hinge.

13. A label dispenser as defined in claim 12 wherein the enclosure includes a top cover and a main housing that are movable relative to each other to expose the compartment.

14. A label dispenser as defined in claim 13 wherein the top cover and main housing are joined each other by means of a hinge.

15. A label dispenser as defined in claim 14 wherein the top cover includes the elongate aperture and the main housing includes the planar member.

16. A label dispenser as defined in claim 15 wherein the main housing includes the access door the tape discharge slot and wherein the dispensing slot is formed between the top cover and main housing.

17. A label dispenser as defined in claim 16 wherein the top cover, the main housing, the access door and the hinges are all integrally formed a single unit.

18. A label dispenser as defined in claim wherein the top cover, the main housing, the access door and the hinges are all integrally formed a single unit by means of injection molding.

* * * * *

UNITED STATES PATENT AND TRADEMARK OFFICE

CERTIFICATE OF CORRECTION

PATENT NO. : 5,806,714

DATED : September 15, 1998

INVENTOR(S) : Gerard G. Geiger

It is certified that error appears in the above-identified patent and that said Letters Patent is hereby corrected as shown below:

Column 8, Line 34 After "Claim" insert --- 17 ---

Signed and Sealed this

Sixteenth Day of May, 2000

*Attest:*

Q. TODD DICKINSON

*Attesting Officer*

*Director of Patents and Trademarks*